US011523718B2

(12) United States Patent
Yang

(10) Patent No.: US 11,523,718 B2
(45) Date of Patent: Dec. 13, 2022

(54) TOILET BRUSH WITH QUICK REPLACEABLE CLEANING HEAD

(71) Applicant: SUNYEE BRUSH LAND CO., LTD., Taipei (TW)

(72) Inventor: Tsung-Han Yang, Taipei (TW)

(73) Assignee: Sunyee Brush Land Co., Ltd., Taipei (TW)

( * ) Notice: Subject to any disclaimer, the term of this patent is extended or adjusted under 35 U.S.C. 154(b) by 351 days.

(21) Appl. No.: 16/747,863

(22) Filed: Jan. 21, 2020

(65) Prior Publication Data

US 2021/0219795 A1 Jul. 22, 2021

(51) Int. Cl.

| | |
|---|---|
| ***A47K 11/10*** | (2006.01) |
| ***A46B 7/04*** | (2006.01) |
| ***A46B 5/00*** | (2006.01) |

(52) U.S. Cl.

CPC ..... *A47K 11/10* (2013.01); *A46B 5/0095* (2013.01); *A46B 7/04* (2013.01); *A46B 2200/304* (2013.01)

(58) Field of Classification Search

CPC ..... A47K 11/10; A46B 5/0095; A46B 7/04

See application file for complete search history.

(56) References Cited

U.S. PATENT DOCUMENTS

2007/0089224 A1* 4/2007 Wildauer ..... E03C 1/308 4/255.11

FOREIGN PATENT DOCUMENTS

DE 202013101982 U1 * 7/2013 ..... A47K 11/10

* cited by examiner

*Primary Examiner* — Shay Karls

(74) *Attorney, Agent, or Firm* — Rosenberg, Klein & Lee

(57) ABSTRACT

A toilet brush with a quick replaceable cleaning head is disclosed herein. It comprises a rod body having a first end and a second end; a handle disposed at the first end of the rod body; a feeding unit for connecting the handle; an action rod accommodated in the rod body for connecting the feeding unit and having a clamping head; and a cleaning head having a sleeve and an aperture into which the clamping head is inserted.

10 Claims, 8 Drawing Sheets

TOILET BRUSH WITH QUICK REPLACEABLE CLEANING HEAD

BACKGROUND OF THE INVENTION

1. Field of the Invention

The present invention relates to a toilet brush with a quick replaceable cleaning head. It allows users for not directly touching an unclean head of a toilet brush by hand for purposes of easy and swift replacement thereof.

2. Description of Related Art

A toilet cleaning brush generally comprises a handle and a brush head fixedly connected at one end of the handle. Therefore, when the brush head is impaired, even if the handle is not worn, the entire toilet brush must be discarded and replaced, which causes waste of material resources. To solve abovementioned problem, toilet cleaning brushes having detachable brush heads which can be detached from handles are developed.

However, when replacing the detachable brush head, the user must hold the brush head with one hand and the handle with the other hand, and then twist the handle firmly to disengage the brush head from the handle. This disassembly method of the conventional toilet cleaning brush is laborious and time-consuming, and it is unsanitary to directly hold the used unclean brush head for replacement by hand.

SUMMARY OF THE INVENTION

In view of the above-mentioned problems, the object of the present invention is to provide a toilet brush with a quick replaceable cleaning head. For the effect of quickly replacing an unclean head of a toilet brush, this invention allows users for not directly touching the unclean head of the toilet brush by hand.

The toilet brush of the present invention comprises a rod body having a first end and a second end opposite to the first end; a handle disposed at the first end of the rod body; a feeding unit connected to the handle; an action rod accommodated in the rod body for connecting the feeding unit and having a clamping head; and a cleaning head having a sleeve into which the clamping head of the action rod is inserted.

Accordingly, when the handle is given a force to bring the feeding unit to pull the action rod in a direction opposite to the cleaning head, the impaired cleaning head is detached from the action rod to be replaced with a new one. Then, the sleeve of the new cleaning head is inserted into the clamping head of the action rod for connection by applying a force on the handle to bring the feeding unit to push the action rod toward the cleaning head. Therefore, the present invention achieves the effect of quickly replacing the cleaning head of the toilet brush without need to directly touch the used unclean head by hand.

DETAILED DESCRIPTION OF THE PREFERRED EMBODIMENT

Figure 1:
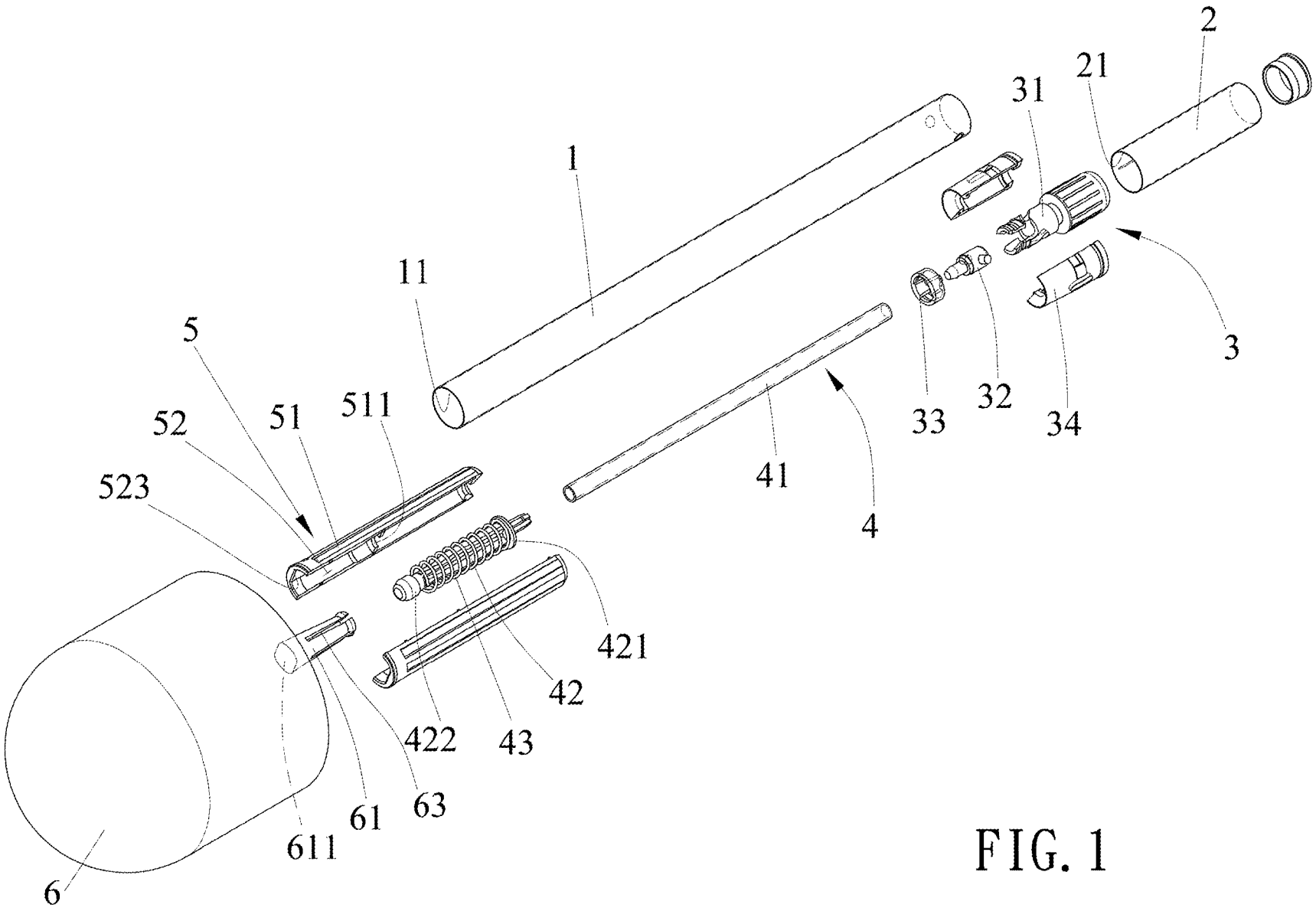
FIG. 1 is an explosion diagram showing a toilet brush with a quick replaceable cleaning head according to the present invention.
Figure 2:
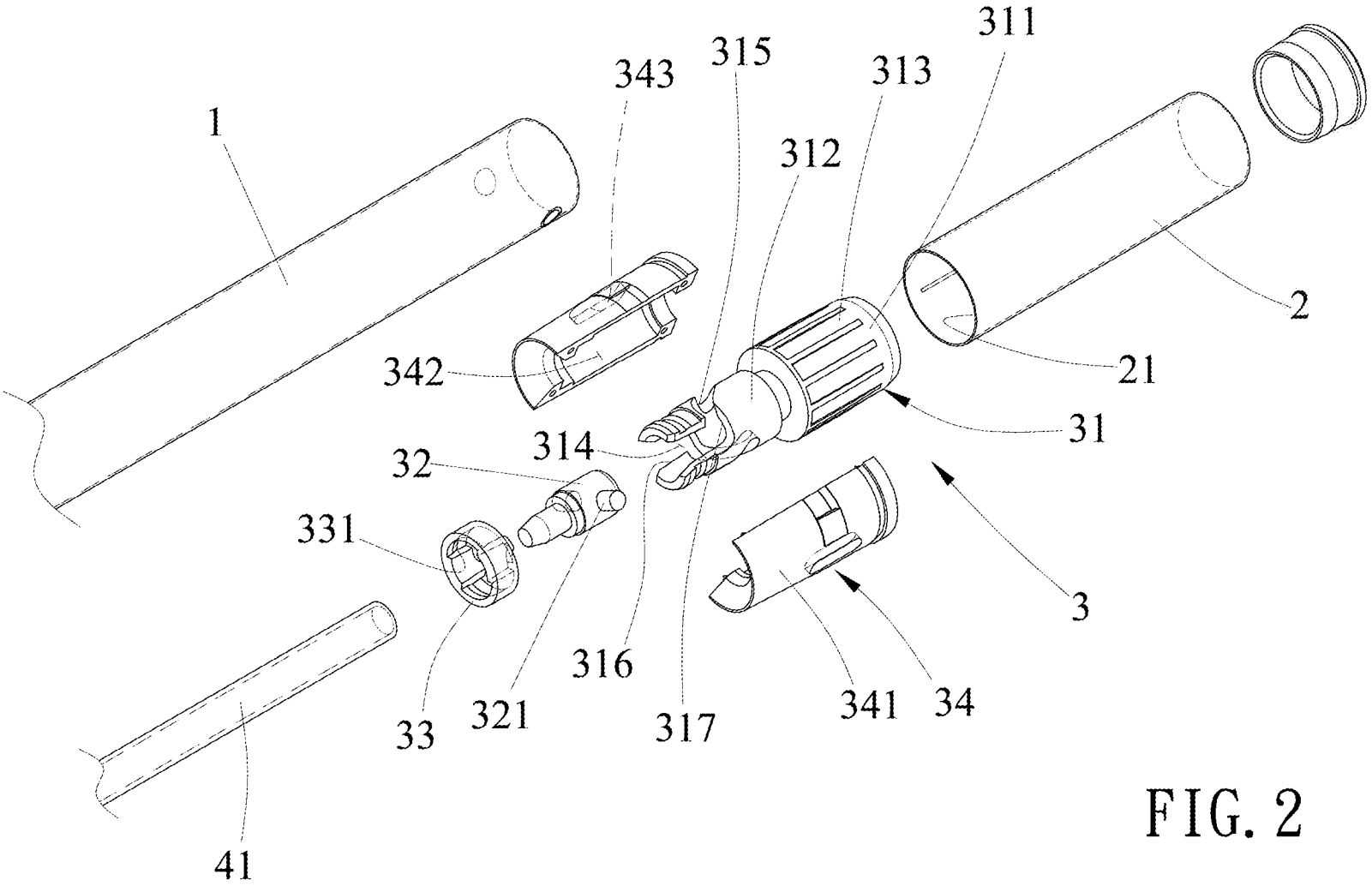
FIG. 2 is a partial enlarged explosion diagram showing a toilet brush with a quick replaceable cleaning head according to the present invention.

Hereinafter, an exemplary embodiment of the present invention will be described in detail with reference to the accompanying drawings.

As showed in FIG. 1 to FIG. 4, a toilet brush with a quick replaceable cleaning head according to the present invention is disclosed herein. It comprises a rod body (1) having a first end, a second end opposite to the first end, and a through hole (11) penetrating through the first end and the second end thereof; a handle (2) disposed at the first end of the rod body (1) and having a fixing hole (21); a feeding unit (3) having a transmission member (31), a displacement unit (32) connected to the transmission member (31), a positioning ring (33) and a packing sleeve (34); an action rod (4) accommodated in the through hole (11) of the rod body (1) and having a first section (41), a second section (42) and an elastic member (43) sleeved on the second section (42); a bushing (5) inserted into the through hole (11) at the second end of the rod body (1); and a cleaning head (6).

The feeding unit (3) is disposed in the through hole (11) at the first end of the rod body (1). The transmission member (31) is provided with a fixing part (311) at a first end thereof for correspondingly and fixedly assembling to the fixing hole (21) of the handle (2), a shaft part (312) at a second end thereof, a plurality of anti-slip strips (313) disposed on an outer wall of the fixing part (311), a shaft hole (314) at a center of the shaft part (312), two spiral guide grooves (315) axially disposed on an outer wall of the shaft part (312) and arranged opposite to each other, two longitudinal guide grooves (316) respectively extended from a top end of the shaft part (312) toward the two spiral guide grooves (315), and two transverse grooves (317) radically formed on a wall of the transmission member (31) and opposite to each other for respectively connecting between the two spiral guide grooves (315) and the two longitudinal guide grooves (316). The displacement unit (32) is correspondingly accommodated in the shaft hole (314) at the shaft part (312) of the transmission member (31) and provided with two guide columns (321) respectively at two laterals thereof. The two guide columns pass through the two longitudinal guide grooves (316) on the shaft part (312) of the transmission member (31) and the two transverse grooves (317) and then respectively insert into the two spiral guide grooves (315). The positioning ring (33) is provided with a via hole (331) at a center thereof to sleeve on the two longitudinal guide grooves (316) on the shaft part (312) of the transmission member (31) for connection. The packing sleeve (34) is provided with two shells (341) opposite to each other, a perforation (342) defined by a combination of the two shells (341) for accommodating the shaft part (312) of the transmission member (31), the displacement unit (32) and the positioning ring (33), and two guiding slots (343) respectively and axially arranged on the two shells (341). The two guide columns (321) of the displacement unit (32) respectively pass through the two spiral guide grooves (315) and further insert into the two guiding slots (343). The packing sleeve (34) as well as the shaft part (312) of the transmission member (31), the displacement unit (32) and the positioning ring (33) accommodated in the packing sleeve (34) are assembled to the through hole (11) at the first end of the rod body (1).

The first section (41) includes a first end for assembling to the displacement unit (32) of the feeding unit (3) and a second end opposite to the first end thereof.

The second section (42) is tapered and includes a first end for connecting the second end of the first section (41) and a second end opposite to the first end thereof. The second section (42) is further provided with a first stop edge (421) at the first end thereof and a clamping head (422) formed at the second end thereof.

The bushing (5) is provided with two casings (51) opposite to each other, an engaging hole (52) defined by a combination of the two casings (51) for accommodating the second section (42) of the action rod (4), two second stop edges (511) respectively formed at two inner walls of the two casings (51) to divide the engaging hole (52) into a first part (521), a second part (522), and a polygonal orifice (523) at the second part (522) of the engaging hole (52). The first stop edge (421) of the second section (42) and the elastic member (43) are located in the first part (521). The elastic member (43) contacts the first stop edge (421) of the second section (42) and the two second stop edges (511) of the two casings (51) to be positioned. The clamping head (422) of the second section (42) is located in the second part (522).

The cleaning head (6) is provided with a sleeve (61) at one end thereof, an aperture (62) disposed at a center of the sleeve (61), and a plurality of concave ditches (63) axially formed on a wall thereof for communicating with the aperture (62) so that the aperture (62) is expansible. A first end of the sleeve (61) of the cleaning head (6) is tapered, and a second end of the sleeve (61) of the cleaning head (6) is provided with a polygonal connecting part (611). The sleeve (61) is inserted into the engaging hole (52) of the bushing (5) in the through hole (11) at the second end of the rod body (1) to be positioned in the second part (522) of the engaging hole (52), and the polygonal connecting part (611) is correspondingly engaged with the polygonal orifice (523) at the second part (522) of the engaging hole (52) of the bushing (5) for positioning.

Furthermore, a diameter of the aperture (62) in the sleeve (61) is less than a diameter of the clamping head (422) of the second section (42) of the action rod (4). Therefore, the clamping head (422) of the second section (42) can be inserted into the aperture (62) in the sleeve (61) for firmly combination.

Figure 5:
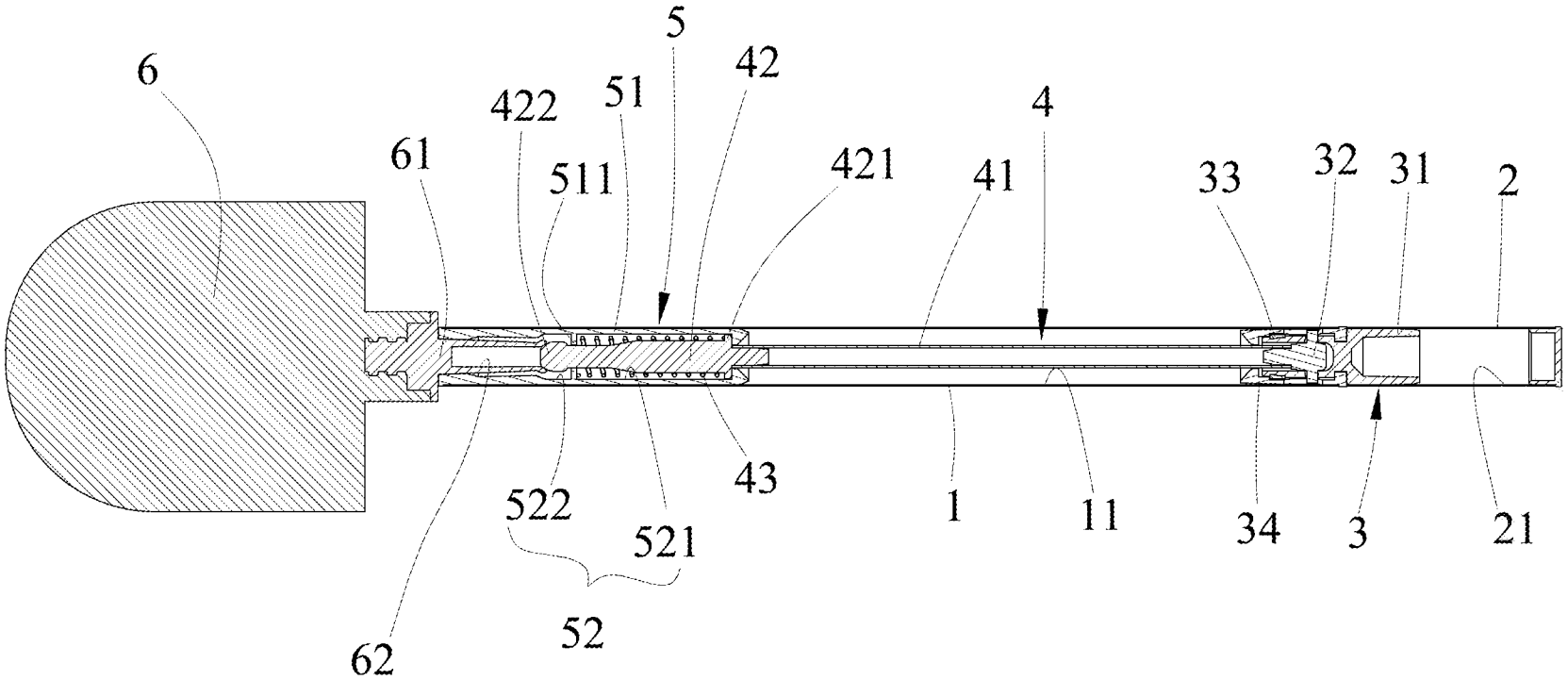
FIG. 5 is a cross-sectional view showing an action rod detached from a cleaning head.
Figure 6:
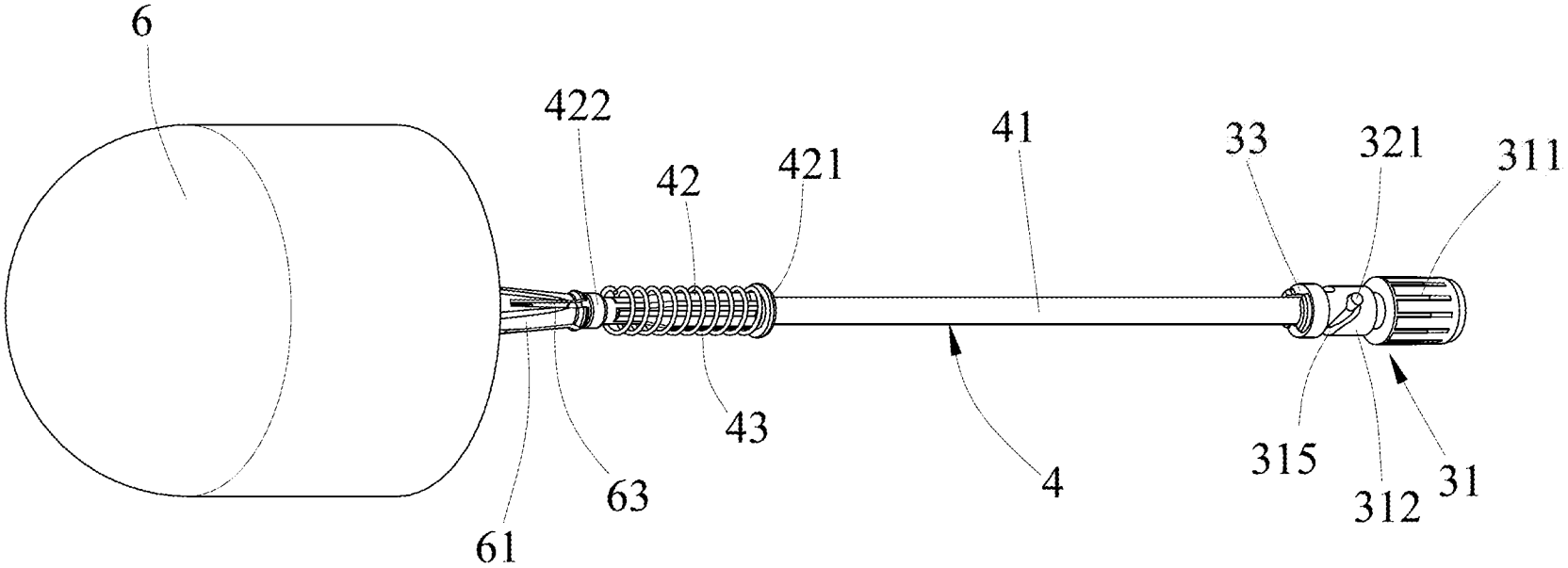
FIG. 6 is a stereogram showing an action rod detached from a cleaning head.

If the cleaning head (6) of the present invention is impaired, it can be replaced with a new one. Referring to FIG. 5 and FIG. 6, the rod body (1) is held by a user with one hand and the handle (2) is held with the other hand to apply a force to rotate the handle (2) in a first direction (e.g. counterclockwise) so that the transmission member (31) fixedly connected to the handle (2) rotates in the same direction synchronously. In such a case, the two guide columns (321) of the displacement unit (32) are disengaged from the two transverse grooves (317) of the transmission member (31) and guided along the two spiral guide grooves (315) and the two guiding slots (343) of the packing sleeve (34) to move in a direction opposite to the cleaning head (6). At the same time, the action rod (4) connected to the displacement unit (32) is also fed in the to direction opposite to the cleaning head (6) simultaneously, so the clamping head (422) of the action rod (4) is separated from the aperture (62) in the sleeve (61) of the cleaning head (6). Therefore, the cleaning head (6) is dropped from the engaging hole (52) of the bushing (5) by gravity and separated from the rod body (1) as shown in FIG. 7.

Figure 3:
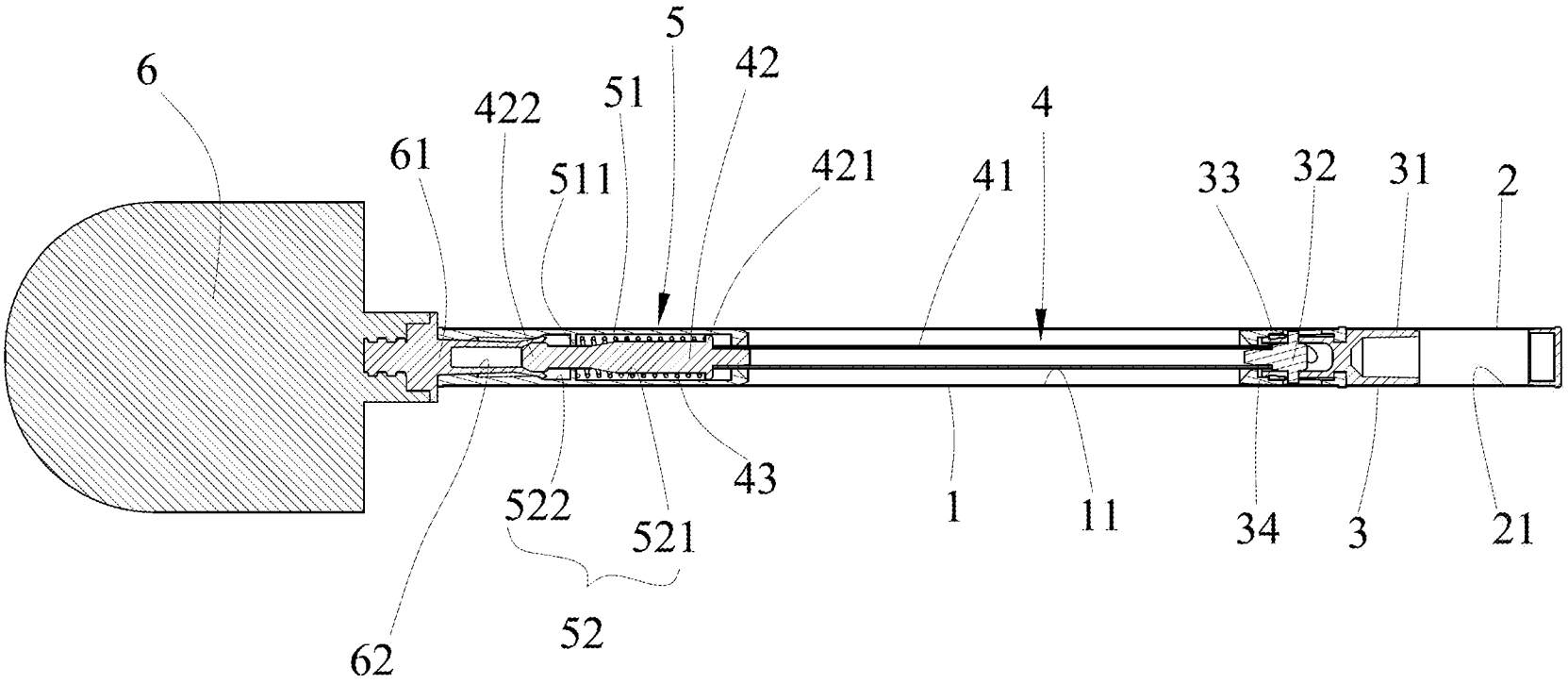
FIG. 3 is a cross-sectional view showing a toilet brush with a quick replaceable cleaning head according to the present invention.
Figure 4:
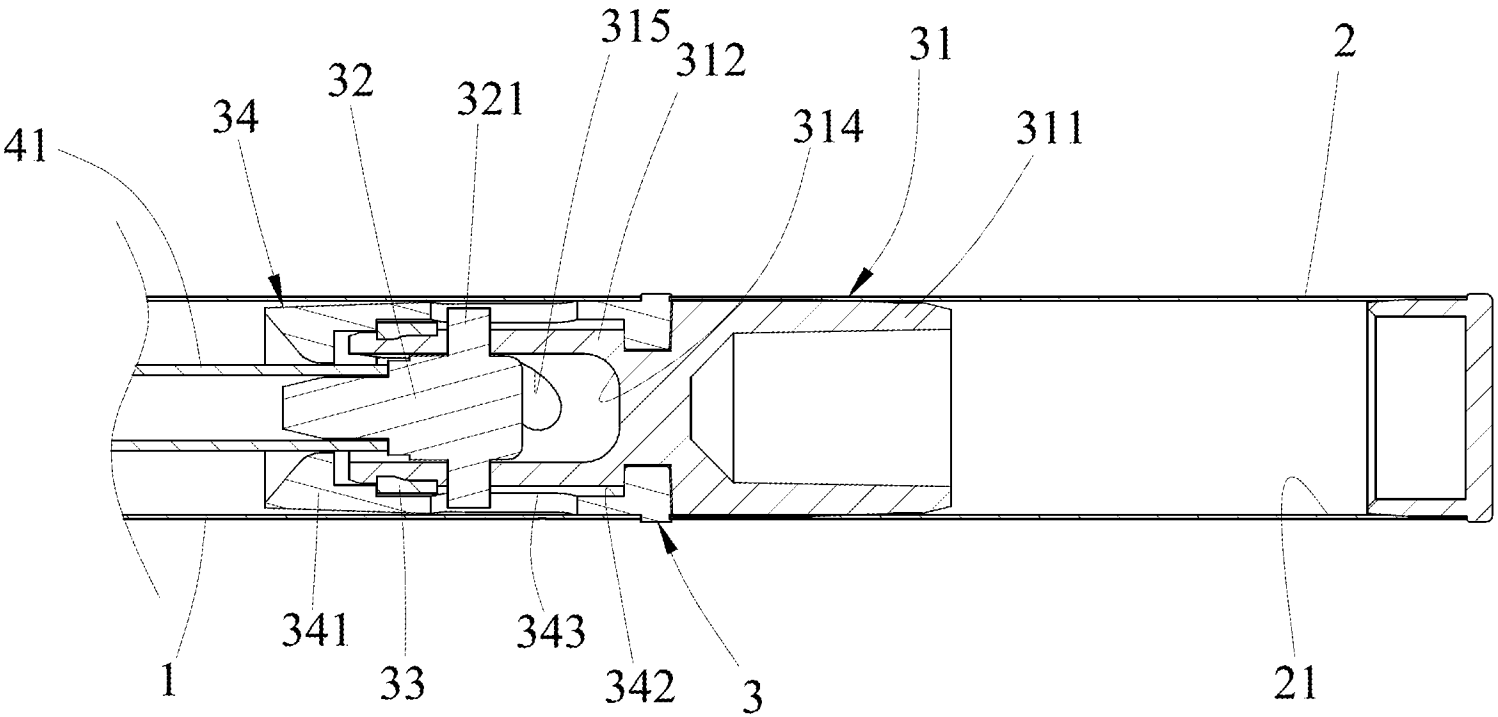
FIG. 4 is a partial enlarged cross-sectional view showing a toilet brush with a quick replaceable cleaning head according to the present invention.
Figure 8:
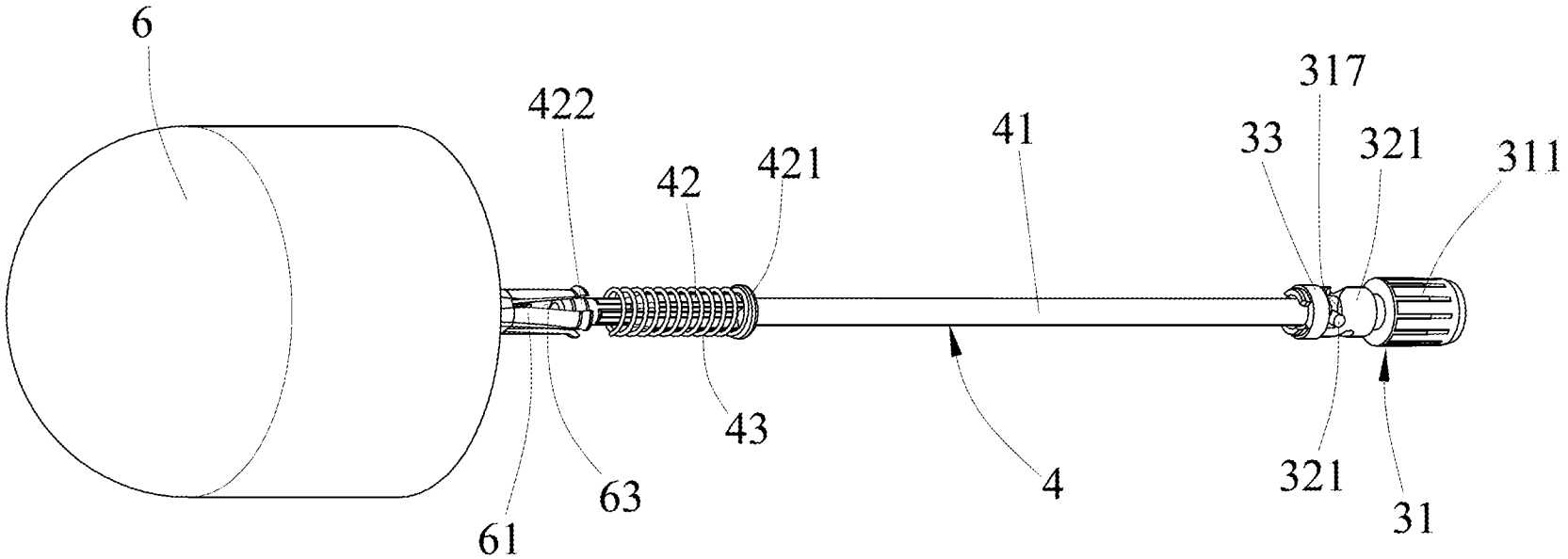
FIG. 8 is a stereogram showing an action rod inserted into a cleaning head.

After the used cleaning head (6) is removed from the rod body (1), the sleeve (61) of the new cleaning head (6) is inserted into the engaging hole (52) of the bushing (5) in the through hole (11) at the second end of the rod body (1). Referring to FIG. 3 and FIG. 4, the rod body (1) is held by the user with one hand and the handle (2) is held with the other hand to apply a force to rotate the handle (2) in a second direction (e.g. clockwise) opposite to the first direction so that the transmission member (31) fixedly connected to the handle (2) rotates in the same direction synchronously. In such a case, the two guide columns (321) of the displacement unit (32) are guided by the two spiral guide grooves (315) of the transmission member (31) and the two guiding slots (343) of the packing sleeve (34) to move toward the cleaning head (6) and finally engaged with the two transverse grooves (317) as shown in FIG. 8. At the same time of the displacement unit (32) moving toward the cleaning head (6), the action rod (4) connected to the displacement unit (32) is also fed in the same direction toward the cleaning head (6) simultaneously, so the clamping head (422) of the second section (42) of the action rod (4) is inserted into the aperture (62) in the sleeve (61) of the cleaning head (6). The aperture (62) is expansible due to the design of the plurality of concave ditches (63) axially formed on the wall thereof. In this way, when the clamping head (422) of the second section (42) is inserted into the aperture (62) of the sleeve (61), the aperture (62) of the sleeve (61) can be moderately opened to allow an insertion of the is clamping head (422). Furthermore, after the clamping head (422) of the second section (42) is inserted into the aperture (62), the aperture (62) of the sleeve (61) returns to its original state to grip and fix the clamping head (422) of the second section (42), so the cleaning head (6) is firmly bonded to the second end of the rod body (1).

Accordingly, the present invention allows users for not directly touching the cleaning head (6) of the toilet brush by hand and meets the purposes of easy and swift replacement thereof.

Figure 7:
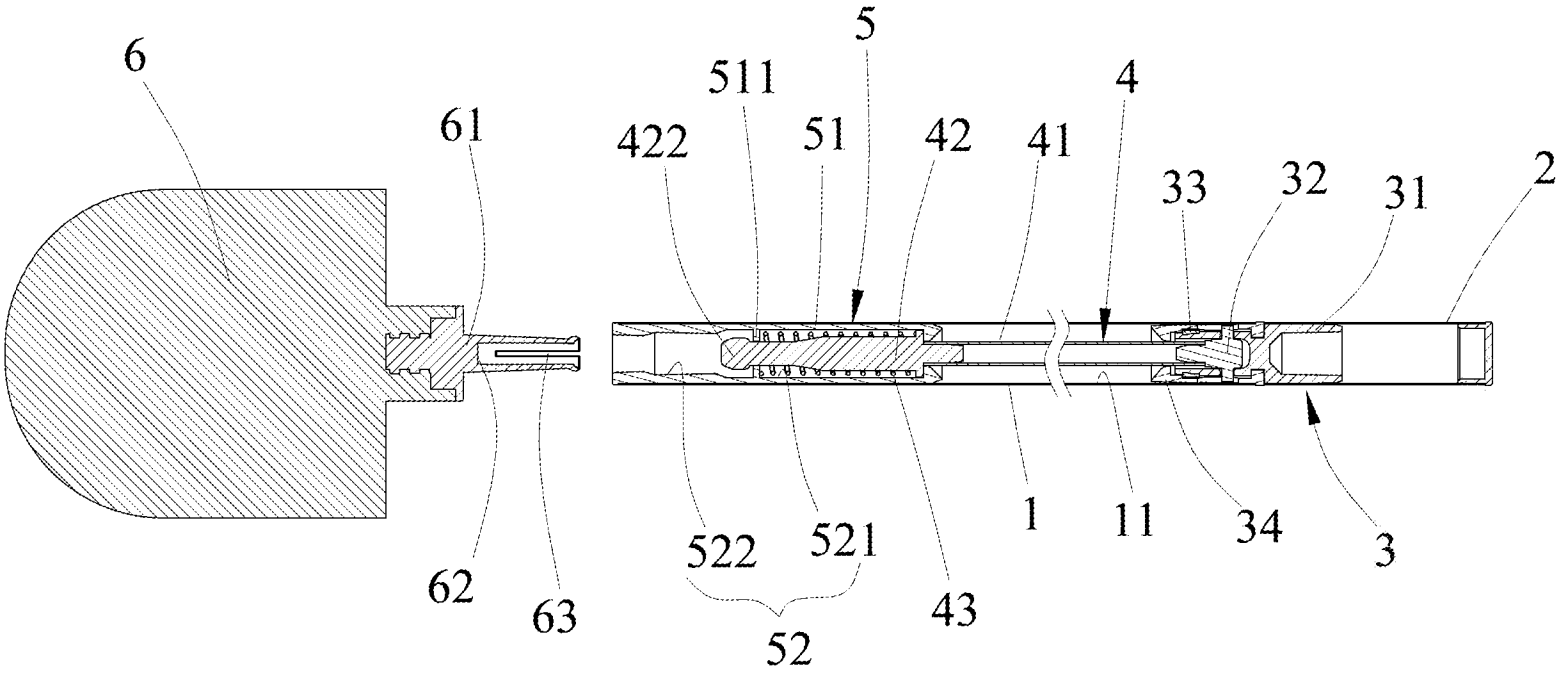
FIG. 7 is a cross-sectional view showing a cleaning head detached from a rod body.

Additionally, referring to FIG. 7, when the second section (42) of the action rod (4) is fed in the direction opposite to the cleaning head (6) and retracts toward the engaging hole (52) of the bushing (5), the elastic member (43) located between the first stop edge (421) of the second section (42) and the two second stop edges (511) of the bushing (5) returns to the original state to push the second section (42) to move away from the cleaning head (6). In this way, the second section (42) is maintained in a retracted state to allow the insertion of the sleeve (61) of the new cleaning head (6) into the engaging hole (52) of the bushing (5). As shown in FIG. 3, after the clamping head (422) of the second section (42) of the action rod (4) is inserted into the sleeve (61) of the cleaning head (6) for combination, the elastic member (43) is compressed. Therefore, when the two guide columns (321) of the displacement unit (32) are disengaged from the two transverse grooves (317) of the transmission member (31) as shown in FIG. 5, the elastic member (43) produces a force to push the second section (42) to move in the direction opposite to the cleaning head (6), so the second section (42) of the action rod (4) can be detached from the cleaning head (6) smoothly.

What is claimed is:

1. A toilet brush with a quick replaceable cleaning head, comprising:

a rod body having a first end, a second end opposite to the first end, and a through hole penetrating through the first end and the second end thereof;

a handle disposed at the first end of the rod body;

a feeding unit disposed in the through hole at the first end of the rod body and comprising a transmission member connectable to the handle and to a displacement unit;

an action rod accommodated in the through hole and having a first end connectable to the displacement unit, a second end opposite to the first end, and a clamping head formed at the second end of the action rod; and a cleaning head configured with a sleeve at one end thereof for inserting into the through hole at the second end of the rod body and an aperture formed in the sleeve, wherein the cleaning head is locked to the rod body by insertion of the clamping head in the aperture of the sleeve by a forward displacement of the action rod within the rod body, and wherein the cleaning head is released from the rod body by withdrawal of the clamping head from the aperture of the sleeve.

2. The toilet brush with a quick replaceable cleaning head as claimed in claim 1, wherein the transmission member of the feeding unit is provided with a fixing part at a first end thereof for assembling to the handle, a shaft part at a second end thereof, a shaft hole at a center of the shaft part for accommodating the displacement unit, two spiral guide grooves axially disposed on an outer wall of the shaft part and arranged opposite to each other, and wherein the displacement unit is provided with two guide columns respectively at two laterals thereof for respectively inserting into the two spiral guide grooves.

3. The toilet brush with a quick replaceable cleaning head as claimed in claim 2, wherein the transmission member of the feeding unit is provided with two transverse grooves radially formed on a wall thereof and opposite to each other for respectively connecting at one end of each of the two spiral guide grooves.

4. The toilet brush with a quick replaceable cleaning head as claimed in claim 2, wherein the feeding unit is provided with a packing sleeve including two shells opposite to each other, a perforation defined by a combination of the two shells for accommodating the shaft part of the transmission member and the displacement unit, and two guiding slots respectively and axially arranged on the two shells into which the two guide columns of the displacement unit passing through the two spiral guide grooves are respectively inserted.

5. The toilet brush with a quick replaceable cleaning head as claimed in claim 2, wherein the transmission member of the feeding unit is provided with two longitudinal guide grooves respectively extended from a top end of the shaft part toward the two spiral guide grooves and two transverse grooves radially formed on a wall thereof and opposite to each other for respectively connecting the two spiral guide grooves to the two longitudinal guide grooves, and wherein the feeding unit is provided with a positioning ring having a via hole at a center thereof to sleeve on the two longitudinal guide grooves for connection.

6. The toilet brush with a quick replaceable cleaning head as claimed in claim 5, wherein the feeding unit is provided with a packing sleeve having two shells opposite to each other, a perforation defined by a combination of the two shells for accommodating the shaft part of the transmission member, the displacement unit and the positioning ring, and two guiding slots respectively and axially arranged on the two shells into which the two guide columns of the displacement unit passing through the two spiral guide grooves are respectively inserted.

7. The toilet brush with a quick replaceable cleaning head as claimed in claim 1, wherein the action rod is provided with a first section having a first end for assembling to the displacement unit of the feeding unit and a second end opposite to the first end thereof, a second section having a first end for connecting the second end of the first section, a second end opposite to the first end thereof, a first stop edge formed at the first end thereof, and the clamping head formed at the second end thereof, and an elastic member sleeved on the second section for contacting the first stop edge for positioning, and wherein a bushing is further provided for inserting into the through hole at the second end of the rod body and having two casings opposite to each other, an engaging hole defined by a combination of the two casings for accommodating the second section of the action rod, two second stop edges respectively formed at two inner walls of the two casings to contact and position the elastic member and to divide the engaging hole into a first part for accommodating the first stop edge and the elastic member and a second part for accommodating the clamping head of the second section.

8. The toilet brush with a quick replaceable cleaning head as claimed in claim 7, wherein a first end of the sleeve of the cleaning head is tapered to insert into the second part of the engaging hole of the bushing in the through hole at the second end of the rod body and provided with a plurality of concave ditches axially formed on a wall thereof for communicating with the aperture, and wherein a diameter of the aperture in the sleeve of the cleaning head is less than a diameter of the clamping head of the second section of the action rod.

9. The toilet brush with a quick replaceable cleaning head as claimed in claim 7, wherein the second part of the engaging hole of the bushing is provided with a polygonal orifice, and wherein a second end of the sleeve of the cleaning head is provided with a polygonal connecting part for correspondingly engaging with the polygonal orifice for positioning.

10. The toilet brush with a quick replaceable cleaning head as claimed in claim 1, wherein a diameter of the aperture in the sleeve of the cleaning head is less than a diameter of the clamping head of the second section of the action rod, and wherein the sleeve of the cleaning head is provided with a plurality of concave ditches axially formed on a wall thereof for communicating with the aperture.

* * * * *